US005262294A

United States Patent [19]

Yagi et al.

[11] Patent Number: 5,262,294

[45] Date of Patent: Nov. 16, 1993

[54] SILVER HALIDE PHOTOGRAPHIC LIGHT SENSITIVE MATERIAL

[75] Inventors: Toshihiko Yagi; Syoji Matsuzaka, both of Hino, Japan

[73] Assignee: Konica Corporation, Tokyo, Japan

[21] Appl. No.: 908,518

[22] Filed: Jun. 26, 1992

Related U.S. Application Data

[63] Continuation of Ser. No. 655,727, Feb. 14, 1991, abandoned.

[30] Foreign Application Priority Data

Feb. 19, 1990 [JP] Japan ..... 2-39004

[51] Int. Cl.[5] ..... G03C 1/035

[52] U.S. Cl. ..... 430/56.7; 430/569

[58] Field of Search ..... 430/567, 569

[56] References Cited

U.S. PATENT DOCUMENTS

| | | | |
|---|---|---|---|
| 4,184,877 | 1/1980 | Maternaghan | 430/567 |
| 4,665,012 | 5/1987 | Sugimoto et al. | 430/502 |
| 4,797,354 | 1/1989 | Saitou et al. . | |
| 4,798,775 | 1/1989 | Yagi et al. . | |
| 4,963,467 | 10/1990 | Ishikawa et al. . | |
| 5,004,680 | 4/1991 | Yagi et al. | 430/567 |
| 5,017,469 | 5/1991 | Mowforth et al. . | |
| 5,087,555 | 2/1992 | Saitou | 430/567 |

FOREIGN PATENT DOCUMENTS

| | | |
|---|---|---|
| 165576 | 12/1985 | European Pat. Off. . |
| 263507 | 4/1988 | European Pat. Off. . |
| 309119 | 3/1989 | European Pat. Off. . |
| 323215 | 7/1989 | European Pat. Off. . |
| 326853 | 8/1989 | European Pat. Off. . |
| 3310609 | 10/1983 | Fed. Rep. of Germany . |

*Primary Examiner*—Janet C. Baxter

*Attorney, Agent, or Firm*—Jordan B. Bierman

[57] ABSTRACT

A silver halide photographic light-sensitive material comprises a silver halide photographic emulsion containing tabular silver halide twin crystal grains having a ratio of grain diameter to thickness of less than 5, wherein projection areas of said silver halide grains are 50% or more of total projection area of all grains; and said silver halide grains are monodipersed and have relatively high iodide content in the interior of the grain. The silver halide grain emulsion is prepared by supplying a silver component and a halide component in the presence of continuously supplied silver halide grains whose solubility product is lower than that of growing monodispersed silver halide grains for at least a given period of time during the grain growth. The photographic material provides improved sensitivity and image quality.

5 Claims, No Drawings

SILVER HALIDE PHOTOGRAPHIC LIGHT SENSITIVE MATERIAL

This application is a continuation of application Ser. No. 655727, filed Feb. 14, 1991, now abandoned.

FIELD OF INDUSTRIAL APPLICATION

The present invention relates to a silver halide photographic light-sensitive material, more specifically to a silver halide photographic light-sensitive material which offers high sensitivity and high quality.

BACKGROUND OF THE INVENTION

Recently, there have been increasing demands for improvements in sensitivity and image quality in silver halide photographic light-sensitive materials. With the aim of meeting these demands, a large number of studies have been made particularly on the morphology, production, etc. of silver halide crystals.

Above all, tabular grains of silver halide have been actively investigated by many researchers since they are favorable for sensitivity improvement. Particularly, as disclosed in Japanese Patent Examined Publication No. 38692/1988 and Japanese Patent Publication Open to Public Inspection No. 14636/1986, tabular silver halide emulsions comprising silver iodobromide grains wherein silver iodide is localized are drawing much attention as having excellent properties.

The localized silver iodide described above is produced by supplying a water-soluble silver salt and a water-soluble halide into an aqueous solution containing a protective colloid by the double jet method or the triple jet method and depositing them on silver halide crystals.

Japanese Patent Publication Open to Public Inspection No. 58237/1987 and Japanese Patent Examined Publication No. 38692/1988 disclose a production method of producing a silver halide emulsion comprising twin crystals either by adding a portion of the silver iodide to be deposited in an aqueous halogen solution and carrying out a conversion reaction with a highly soluble halide or by adding a portion of the silver iodide to be deposited as such and depositing it on silver halide crystals.

Japanese Patent Publication Open to Public Inspection No. 153428/1977 discloses a production method for a silver halide emulsion comprising twin crystals in which silver iodide crystals are first formed, and then silver ions and bromide ions are supplied by the double jet method and a silver iodobromide emulsion is formed.

Japanese Patent Publication Open to Public Inspection No. 183644/1989 discloses a production method for a tabular silver halide in which fine grains of silver iodobromide crystal prepared outside the reactor are supplied to the reactor and deposited on the seed crystal.

As stated above, there have been a variety of methods proposed to introduce iodide ions into silver halide crystal or to localize iodide ions in the crystal.

Meanwhile, with respect to grains of tabular twin crystal, the prior art includes a tabular twin crystal emulsion with uniform grain size, described in Japanese Patent Publication Open to Public Inspection No. 14636/1986, and another tabular twin crystal emulsion wherein the relative standard deviation among the grains is not more than 20%, described in Japanese Patent Publication Open to Public Inspection No. 209445/1987.

However, these methods do not offer a satisfactory improving effect, and it is expected that a new silver halide emulsion and a method of its production will be developed.

SUMMARY OF THE INVENTION

Accordingly, the object of the present invention is to provide a silver halide photographic light-sensitive material which offers high sensitivity and high image quality, more specifically a light-sensitive silver halide emulsion which serves to accomplish the object described above and a method of its production.

The object of the present invention described above is accomplished by the silver halide photographic light-sensitive material described below.

(1) A silver halide photographic light-sensitive material comprising a silver halide photographic emulsion containing tabular silver halide grains wherein the grain diameter/thickness ratio is below 5 for more than 50% of the total projected area of all grains, and said silver halide photographic emulsion satisfies all the following requirements 1 through 4.

1) The silver halide grains are monodispersed, and the (grain size standard deviation/average grain size)$\times$100 is not more than 18.

2) The average silver iodide content ($J_1$) determined by X-ray fluorometry and the average value ($J_2$) for measurements of silver iodide content taken on silver halide crystal at a point over 80% apart from the center in the direction of diameter of the silver halide grain by X-ray microanalysis maintain the relationship of $J_1 > J_2$.

3) For the average silver iodide content of each silver halide grain determined by X-ray microanalysis, the relative standard deviation is not more than 20%.

4) A signal exists over a diffraction angle range of 1.5 degrees or more at a maximum peak height$\times$0.13 in (420) X-ray diffraction using CuK$\alpha$ ray as the irradiation source.

(2) A silver halide photographic light-sensitive material having at least one silver halide emulsion layer containing silver halide grains (A) comprising monodispersed twin crystals with two or more kinds of halogen, characterized in that said grains (A) have been grown in the presence of continuously supplied silver halide grains (B) whose solubility product is lower than that of growing monodispersed silver halide grains for at least a given period of time during the grain growth process.

DETAILED DESCRIPTION OF THE INVENTION

The twin crystal mentioned herein means a silver halide crystal wherein more than one twin plane is present in each grain. Detailed description of the morphological classification of twin crystals appears in a report by Klein and Moisar "Photographishe Korrespondenz", vol. 99, p. 99 and vol. 100, p.57. The two or more planes of the twin crystal may be parallel to each other or not.

The silver halide emulsion of the present invention preferably mainly comprises two or more parallel twin planes, with further preference given to an even number of twin planes, ideally two twin planes.

In the present invention, "mainly comprising a twin crystal having two or more parallel twin planes" means that the number ratio of grains of twin crystal grains having two or more parallel twin planes is not less than 50%, preferably not less than 60%, and ideally not less than 70%, as counted in the descending order of grain size.

The twin crystal of the present invention may be any one of a twin crystal comprising {111} planes, a twin crystal comprising {100} planes and a twin crystal comprising both of them, but preference is given to a twin crystal comprising {111} planes.

With respect to a twin crystal grain having two or more parallel twin planes, it is preferable that the ratio of the diameter of the circle converted from a projection of the grain at a right angle with respect to the twin plane and the distance (thickness) of two parallel extragranular surfaces be 1 to 20, more preferably between 1.2 and 8, and ideally between 1.5 and 5.0.

In the present invention, "mainly comprising twin crystals" means that the number ratio of twin crystal grains to all grains is not less than 60%, preferably not less than 80%, and ideally between 95 and 100%.

In the present invention, the silver iodobromide emulsion mainly comprising twin crystals is a monodispersed emulsion.

In the present invention, the monodispersed silver halide emulsion means a silver halide emulsion wherein the weight of silver halide grains which fall in the grain size range ±20% of the average grain size $\bar{d}$ is not less than 70% of the total silver halide weight, preferably not less than 80%, and more preferably not less than 90%.

Here, average grain diameter $\bar{d}$ is defined as the grain diameter di which gives a maximum value for $ni \times di^3$, wherein di denotes the grain diameter and ni denotes the number of grains having a diameter of di (significant up to three digits, rounded off at the last digit).

The grain diameter stated here is the diameter of a circle converted from a grain projection image with the same area.

Grain size can be obtained by measuring the diameter of the grain or the area of projected circle on an electron micrograph taken at ×10000 to 50000 (the number of subject grains should be not less than 1000 randomly).

A highly monodispersed emulsion preferred for the present invention has a distribution width of not more than 20%, more preferably not more than 15%, defined as follows:

$$\frac{\text{Grain size standard deviation}}{\text{average grain size)}} \times 100 = \text{distribution width (\%)}$$

Here, grain size is measured by the method described above, and average grain size is expressed in arithmetic mean.

$$\text{Average grain size} = \frac{\Sigma dini}{\Sigma ni}$$

The average grain size of the silver halide emulsion of the present invention is preferably 0.1 to 10.0 μm, more preferably 0.2 to 5.0 μm, and still more preferably 0.3 to 3.0 μm.

The silver halide emulsion of the present invention preferably comprises a silver iodobromide having an average silver iodide content of 4 to 20 mol %, more preferably 5 to 15 mol %.

The silver halide emulsion of the present invention may contain silver chloride as long as the effect of the present invention is not interfered with.

The silver halide emulsion of the present invention meets the relationship of $J_1 > J_2$ when the average silver iodide content ($J_1$) obtained by fluorescence X-ray analysis and the average value ($J_2$) of measurements of silver iodide content obtained on silver halide crystal at a point over 80% apart from the core in the direction of grain diameter by X-ray microanalysis are compared.

X-ray microanalysis is described below. Silver halide grains are dispersed in an electron microscopic grid on an electron microscope in combination with an energy dispersion type X-ray analyzer, and magnification power is set so that a single grain appears in the CRT field under cooling with liquid nitrogen. The intensity of AgLα ray and that of ILα ray are integrated for a given period. From the ILα/AgLα intensity ratio and a calibration curve prepared in advance, the silver iodide content can be calculated. The center of the grain is the center of an tangential circle.

The emulsion of the present invention satisfies the requirements that when the average silver iodide content for each silver halide grain is measured by the X-ray microanalysis technique described above, the relative standard deviation should be not more than 20%, preferably not more than 15%, and ideally not more than 12%.

Here, the relative standard deviation is obtained by multiplying by 100 the value obtained by dividing by the average silver iodide content the standard deviation of silver iodide content for a given number of emulsion grains, for example, 100 emulsion grains.

The silver halide emulsion of the present invention is characterized by the presence of a signal over a range of not less than 1.5 degrees of diffraction angle at a maximum peak height ×0.13 of (420) X-ray diffraction using CuKα ray as the irradiation source. It is more preferable that a signal exists over a range of not less than 1.5 degrees, still more preferably not less than 1.8 degrees, and ideally not less than 2.0 degrees, of diffraction angle at a maximum peak height ×0.15.

The signal preferably exists continuously.

The existence of a signal means that the signal has an intensity exceeding the maximum peak height at the maximum peak height ×0.13 or 0.15.

A more preferred mode of the silver halide emulsion of the present invention is such that the (420) X-ray diffraction signal described above, obtained using CuKα ray as the irradiation source, has two or three peaks, with further preference given to the possession of three peaks.

As a means of examining the crystalline structure of silver halide, X-ray diffraction is known.

As the X-ray irradiation source, various characteristic X-rays can be used, of which CuKα ray, wherein Cu is the target, is most commonly used.

Silver iodobromide has a rock salt structure, and its (420) diffraction signal with CuKα ray is observed at $2\theta = 71°$ to 74°. Since its signal intensity is relatively high and the angle is high, it offers good resolution, thus best suiting to investigation of crystalline structure.

In measuring the X-ray diffraction of a photographic emulsion, it is necessary to remove the gelatin and mix a reference material such as silicon and use the powder method.

The determination can be achieved with reference to, for example, Kiso Bunseki Kagaku Koza 24 "X-ray Analysis", published by Kyoritsu Shuppan.

The emulsion of the present invention preferably satisfies the following requirements.

The average silver iodide content ($J_1$) obtained by fluorescent X-ray analysis and the grain surface silver iodide content ($J_3$) obtained by X-ray photoelectron spectrometry maintain the relationship of $J_1 > J_3$.

X-ray photoelectron spectrometry is described below.

Prior to X-ray photoelectron spectrometry, the emulsion is pre-treated as follows: First, a pronase solution is added to the emulsion, followed by gelatin decomposition with stirring at 40° C. for 1 hour. Then, centrifugation is conducted to precipitate the emulsion grains. After removing the supernatant, an aqueous solution of pronase is added, followed by further gelatin decomposition under the same conditions as above. The sample thus treated is re-centrifuged. After removing the supernatant, distilled water is added to disperse the emulsion grains therein, followed by centrifugation and decantation. After this washing procedure is repeated in three cycles, the emulsion grains are dispersed in ethanol. The resulting dispersion is thinly applied over a mirror-polished silicon wafer to yield a subject sample.

X-ray photoelectron spectrometric determination is made using, for example, the ESCA/SAM560 model spectrometer, produced by PHI Co., under conditions of Mg-K$\alpha$ ray as the excitation X-ray, 15 KV of X-ray source voltage, 40 mA of X-ray source current and 50 eV of pass energy.

To determine the surface halide composition, Ag3d, Br3d, and I3d 3/2 electrons are detected. Composition ratio is calculated from the integrated intensity in each peak by the relative sensitivity coefficient method. The composition ratio is obtained as an atomic number percent ratio using relative sensitivity coefficients of 5.10, 0.81 and 4.592 respectively for Ag3d, Br3d and I3d3/2.

The silver halide emulsion of the present invention has a phase of high silver iodide content in each grain.

The silver iodide content of the high silver iodide content phase is preferably 15 to 45 mol %, more preferably 20 to 42 mol %, and ideally 25 to 40 mol %.

The high silver iodide content phase of the silver halide grains of the present invention is covered with a lower silver iodide content phase or silver chlorobromide phase.

The average silver iodide content of the lower silver iodide content phase, which forms the outermost phase, is preferably not more than 6 mol %, ideally 0 to 4 mol %. Also, another phase containing silver iodide (intermediate phase) may be present between the outermost phase and the high silver iodide content phase.

The silver iodide content of the intermediate phase is preferably 10 to 22 mol %, and ideally 12 to 20 mol %.

It is preferable that a difference of not less than 6 mol %, ideally not less than 10 mol %, exists between the outermost phase and the intermediate phase, and between the intermediate phase and the inner high silver iodide content phase.

In the mode of embodiment of the present invention described above, another silver halide phase may be present in the center of the inner high silver iodide content phase, between the inner high silver iodide content phase and the intermediate phase, and between the intermediate phase and the outermost phase.

Also, it is preferable that the volume of the outermost phase be 4 to 70 mol % of the entire grain volume, more preferably 10 to 50 mol %. It is desirable that the volume of the high silver iodide content phase be 10 to 80% of the entire grain volume, more preferably 20 to 50%, and still more preferably 20 to 45%. The volume of the intermediate phase is preferably 5 to 60%, more preferably 20 to 55%, of the entire grain volume.

Each of these phases may be a single phase of uniform composition, or a group of phases of uniform composition with its composition varying in steps. It may also be a continuous phase wherein continuous composition change occurs in any phase, and may be a combination thereof.

Another mode of embodiment of the present invention is such that the silver iodide content changes continuously from the grain center toward outside, rather than a substantially uniform phase of silver iodide localized in each grain. In this case, the silver iodide content preferably decreases monotonously from the point of maximum silver iodide content toward the outside.

The silver iodide content at the point of maximum silver iodide content is preferably 15 to 45 mol %, more preferably 25 to 40 mol %.

It is also preferable that the silver halide be a silver iodobromide or silver chlorobromide with a grain surface phase silver iodide content of not more than 6 mol %, with particular preference given to a silver iodobromide having a silver iodide content of 0 to 4 mol %.

The silver halide emulsion of the present invention can be used in combination with other emulsions as long as the effect of the present invention is not interfered with.

In the production of the silver halide emulsion of the present invention, to prepare silver halide grains (A) mainly comprising monodispersed twin crystals containing two or more kinds of halogen, three elements are necessary: (1) monodispersed silver halide grains in the course of growth to (A), (2) silver halide grains (B) (referred to as AgX fine grains) with a solubility product lower than that of the growing grains, and (3) a supplementary AgX component supplied, along with AgX fine grains, to precipitate the mixed crystal on the seed grains.

The monodispersed seed grains for the present invention mainly comprise twin crystals.

Here, "mainly comprising twin crystals" means that the number ratio of twin crystals exceeds 50%, preferably not less than 80%, and ideally not less than 95%.

Monodispersed twin crystal seed grains can be obtained by ripening multiple twin crystal nucleus grains in the presence of a silver halide solvent to form spherical twin crystal seed grains, as described in Japanese Patent Publication Open to Public Inspection No. 6643/1986, for instance.

Specifically, this method comprises the following processes (a) and (b).

Process (a): A nucleus grain formation process wherein the pBr of the mother liquor is kept between 2.0 and −0.7 during a starting period of exceeding ½ of the stage of precipitation of silver halide having a silver iodide content of 0 to 5 mol %.

Process (b): A seed grain formation process which follows the nucleus grain formation process, wherein a silver halide solvent is added to the mother liquor in a ratio of $10^{-5}$ to 2.0 mol per mol silver halide to form silver halide seed grains which are substantially monodispersed spherical twin crystals.

Here, the mother liquid is a solution (including the silver halide emulsion) used for preparation of the silver halide emulsion until a finished photographic emulsion is obtained.

The silver halide grains formed in the nucleus grain formation process described above are twin crystal grains comprising a silver iodobromide containing 0 to 5 mol % silver iodide.

In the present invention, twin crystal nucleus grains can be obtained by adding a water-soluble silver salt alone or both a water-soluble silver salt and a water-soluble halide while keeping the aqueous solution of protective colloid at a bromine ion concentration of 0.01 to 5 mol/l, i.e, pBr=2.0 to −0.7, preferably 0.03 to 5 mol/l (pBr=1.5 to −0.7) over a starting period of not less than ½ of the nucleus grain formation process.

The nucleus grain formation process for the present invention is defined as a process which precedes the seed grain formation process, which may include a grain growth period after the period of from initiation of addition of the water-soluble silver salt in the protective colloid solution to substantial termination of formation of new crystal nuclei.

In the present invention, the size distribution of nucleus grains is not subjected to limitation, whether it is monodispersed or polydispersed. The polydispersion mentioned herein means that the coefficient of variation for grain sizes (the same as the distribution width described above) exceeds 25%. The nucleus grains of the present invention preferably contain twin crystal grains in a number ratio of at least 50% to all nucleus grains, more preferably not less than 70%, and ideally not less than 90%.

The seed grain formation process wherein the nucleus grains obtained in the nucleus grain formation process are ripen in the presence of a silver halide solvent to yield seed grains comprising monodispersed spherical grains is described below.

Ripening in the presence of a silver halide solvent (hereinafter simply referred to as ripening) is considered as different from Ostwald ripening, in which in the presence of larger grains and smaller grains, the smaller ones dissolve while the larger ones grow, which result in wider grain size distribution. With respect to ripening conditions for the seed grains from the nucleus grains obtained in the nucleus grain formation process described above, substantially monodispersed spherical seed grains are obtained by ripening the mother liquid after being subjected to the nucleus grain formation process in which twin crystal nucleus grains are formed using a silver halide having a silver iodide content of 0 to 5 mol % described above in the presence of a $10^{-5}$ to 2.0 mol/mol silver halide solvent. Being substantially monodispersed means that the distribution width as defined above is less than 25%.

A substantially spherical grain means a grain which is so rounded that {111} planes, {100} planes or other planes are not easily differentiatable from each other by electron micrographic observation of the silver halide grain and wherein if three axes are assumed to intersect with each other at a right angle on a point near the weight center of the grain, the maximum grain diameter L and minimum grain diameter l of the grain in the direction of longitudinal, transversal and vertical directions maintains the relationship of C=L/l =1.0 to 2.0, preferably 1.0 to 1.5.

In the present invention, said spherical grains preferably account for not less than 60% of the all seed grains, more preferably not less than 80%, and it is still more preferable that they account for almost all seed grains.

Examples of the silver halide solvent used in the seed grain formation process of the present invention include (a) the organic thioethers described in U.S. Pat. Nos. 3,271,157, 3,531,289 and 3,574,628, Japanese Patent Publication Open to Public Inspection Nos. 1019/1979 and 158917/1979, and Japanese Patent Examined Publication No. 30571/1983, (b) the thiourea derivatives described in Japanese Patent Publication Open to Public Inspection Nos. 82408/1978, 29829/1980 and 77737/1980, (c) the AgX solvents described in Japanese Patent Publication Open to Public Inspection Nos. 144319/1978 having a thiocarbonyl group between an oxygen or sulfur atom and a nitrogen atom, (d) the imidazoles described in Japanese Patent Publication Open to Public Inspection No. 100717/1979, (e) sulfites, (f) thiocyanates, (g) ammonia, (h) the hydroxyalkyl-substituted ethylenediamines described in Japanese Patent Publication Open to Public Inspection No. 196228/1982, (i) the substituted mercaptotetrazoles described in Japanese Patent Publication Open to Public Inspection No. 202531/1982, (j) water-soluble bromides, and (k) the benzimidazole derivatives described in Japanese Patent Publication Open to Public Inspection No. 54333/1983.

Examples of these silver halide solvents (a) through (k) are given below.

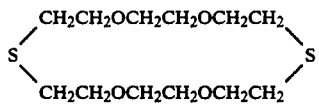
(a)

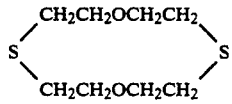

$HOCH_2CH_2SCH_2CH_2SCH_2CH_2OH$

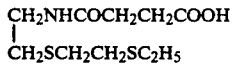

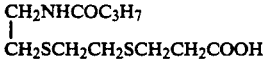

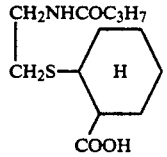

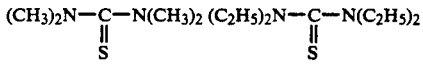
(b)

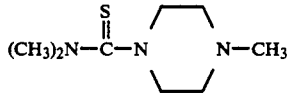

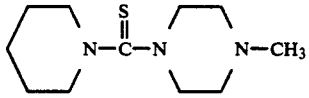

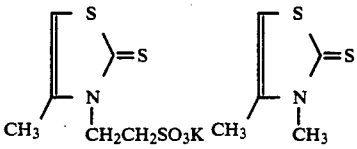
(c)

-continued

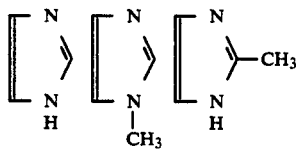

(d)

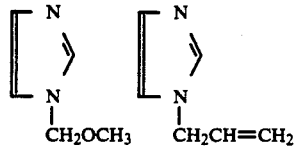

$K_2SO_3$, $Na_2SO_3$ (e)

$NH_4SCN$, KSCN (f)

$NH_3$ (g)

$(HOCH_2CH_2)_2NCH_2CH_2N(CH_2CH_2OH)_2$ (h)

$(CH_3\underset{\underset{OH}{|}}{C}HCH_2)_2NCH_2CH_2N(CH_2\underset{\underset{OH}{|}}{C}HCH_3)_2$ $(C_2H_5)_2NCH_2CH_2N(CH_2CH_2OH)_2$ $(C_2H_5\underset{\underset{OH}{|}}{C}HCH_2)_2NCH_2CH_2N(CH_2\underset{\underset{OH}{|}}{C}HC_2H_5)_2$

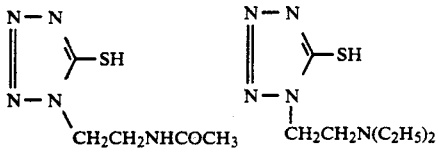

(i)

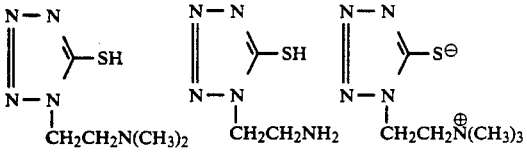

NaBr, $NH_4Br$, KBr (j)

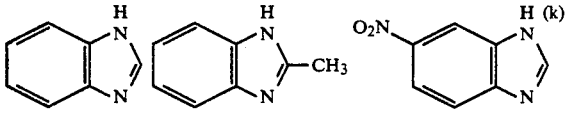

(k)

These solvents can be used in combination of two or more kinds. Examples of preferred solvents include thioethers, thiocyanates, thioureas, ammonia and bromides, with further preference given to a combination of ammonia and bromide.

These solvents are used in a ratio of $10^{-5}$ to 2 mol per mol silver halide.

It is preferable that the pH be 3 to 13 and the temperature be 30° to 70° C., with further preference given to a pH of 6 to 12 and a temperature of 35° to 50° C.

As a preferred mode of embodiment of the present invention, an emulsion containing preferred seed grains was obtained by ripening a combination of 0.4 to 1.0 mol/l ammonia and 0.03 to 0.5 mol/l potassium bromide at a pH of 10.8 to 11.2 and a temperature of 35° to 45° C. for 30 seconds to 10 minutes.

To adjust ripening conditions, an water-soluble silver salt may be added during the seed grain formation process of the present invention.

A combination of silver halide grains (B) with a lower solubility product than that of seed grains and a supplementary AgX component are selected according to the halide composition of the silver halide grains (A) as follows.

| Silver halide grains (A) | Fine AgX grains | Supplementary AgX component |
|---|---|---|
| AgBrI | AgI | Fine AgBr grains or a solution containing a soluble silver salt and a soluble bromide |
| AgBrCl | AgBr | Fine AgCl grains or a solution containing a soluble silver salt and a soluble chloride |
| AgClI | AgI | Fine AgCl grains or a solution containing a soluble silver salt and a soluble chloride |

It is preferable that the fine AgX grains supply at least 50%, more preferably not less than 70%, and ideally not less than 90% of a halide component of silver halide grains (A) whose salt with silver is lower in solubility than the seed grains.

In the preparation of the silver halide emulsion of the present invention, the seed grains preferably exist in the mother liquor along with hydrophilic protective colloid in advance of the fine grains and the supplementary AgX component, and the fine grains of AgX and the supplementary AgX component are continuously supplied to this mother liquid.

Continuous supply includes the addition of fine grains of AgX and supplementary AgX component according to consumption of fine grains of AgX and supplementary AgX component, which addition may be conducted intermittently or in a number of stages.

The supplementary AgX component is preferably a soluble silver salt and soluble halide, which soluble silver salt is exemplified by silver nitrate and which soluble bromide exemplified by potassium bromide and ammonium bromide. Also, the supplementary AgX component may contain a part of the halogen component supplied from the fine grains of AgX as long as it does not interfere with the performance.

The fine grains of AgX are preferably monodispersed. Also, its average grain size should not always be fine, but the average grain size is normally not more than 0.7 μm, preferably 0.3 to 0.005 μm.

For the process of growing the seed emulsion grains in the presence of fine grains of AgX and supplementary AgX component, an optimum addition rate is selected which does not result in the formation of new nuclei or occurrence of Ostwald ripening of growing grains. It is preferable to use ammoniac silver nitrate to prepare the supplementary Agx component.

In the process described above, the mother liquid is kept at a temperature of 10° to 80° C., preferably 20° to 75° C., a pAg of 6 to 11, preferably 7.5 to 10.5, and a pH of 5 to 11, preferably 5.5 to 10.

Upon preparation of AgX emulsion (including preparation of seed emulsion), an AgX grain adsorbing substance other than gelatin may be added. Such adsorptive substances include compounds used in the relevant field as sensitizing dyes, as antifogging agents, or as stabilizers or heavy metal ions. Examples of the adsorptive substance described above are given in Japanese Patent Publication Open to Public Inspection No. 7040/1987. Of the adsorptive substances, at least one kind of antifogging agent or stabilizer is preferably added upon preparation of the seed emulsion since emulsion fogging is reduced and time stability is improved.

Of the antifogging agents and stabilizers described above, heterocyclic mercapto compounds and/or azaindene compounds are preferred. Examples of further preferred heterocyclic mercapto compounds and azaindene compounds are described in detail in Japanese Patent Publication Open to Public Inspection No. 41848/1988, which serve for the present invention.

Although the addition amount of the heterocyclic mercapto compound or azaindene compound is not limited, it is preferably added in a ratio of $1\times10^{-5}$ to $3\times10^{-2}$ mol, more preferably $5\times10^{-5}$ to $3\times10^{-3}$ mol per mol AgX. A proper amount is selected according to AgX grain preparation conditions, average grain size and type of the compound described above.

The finished emulsion after being provided with a given set of grain properties are desalted by a known method after AgX grain formation. Desalting can be accomplished by use of a flocculent gelatin, etc. used to desalt AgX grains as seed grains described in Japanese Patent Application Nos. 81373/1987 and 9047/1988, or by the noodle washing method wherein gelatin is gelled, or by the flocculation method utilizing an inorganic polyvalent anionic substance such as sodium sulfate, anionic surfactant, anionic polymer (e.g., polystyrenesulfonic acid).

In the present invention, the silver halide emulsion should have been subjected to physical ripening, chemical ripening and spectral sensitization. Additives used in these processes are described in Research Disclosure Nos. 17643, 18716 and 308119 (hereinafter referred to as RD17643, RD18716 and RD308119, respectively).

As specified below these additives are described in the corresponding Research Disclosures.

| [Item] | [page in RD308119] | | [RD17643] | [RD18716] |
|---|---|---|---|---|
| Chemical sensitizer | 996 | III-A 23 648 | 23 | 648 |
| Spectral sensitizer | 996 | IV-A-A, B, C, D, H, H, I, J | 23-24 | 648-649 |
| Super-sensitizer | 996 | IV-A-E, J | 23-24 | 648-649 |
| Antifogging agent | 998 | VI | 24-25 | 649 |
| Stabilizer | 998 | VI | | |

Known photographic additives which can be used for the present invention are also described in the above Research Disclosures.

The table below specifies where relevant description appears.

| [Item] | [page in RD308119] | | [RD17643] | [RD18716] |
|---|---|---|---|---|
| Antistaining agent | 1002 | VII-I | 25 | 650 |
| Dye image stabilizer | 1001 | VII-J | 25 | |
| Brightening agent | 998 | V | 24 | |
| UV absorbent | 1003 | VIII-C, XIII C | 25-26 | |
| Optical absorber | 1003 | VIII | 25-26 | |
| Light scattering agent | 1003 | VIII | | |
| Filter dye | 1003 | VIII | 25-26 | |
| Binder | 1003 | IX | 26 | 651 |
| Antistatic agent | 1006 | XIII | 27 | 650 |
| Hardener | 1004 | X | 26 | 651 |
| Plasticizer | 1006 | XII | 27 | 650 |
| Lubricant | 1006 | XII | 27 | 650 |
| Surfactant, coating aid | 1005 | XI | 26-27 | 650 |

-continued

| [Item] | [page in RD308119] | | [RD17643] | [RD18716] |
|---|---|---|---|---|
| Matting agent | 1007 | XVI | | |
| Developer (contained in the sensitive material) | 1011 | XX B | | |

Various couplers can be used for the present invention. Examples thereof are described in the above Research Disclosures.

The table below specifies where relevant description appears.

| [Item] | [page in RD308119] | | [RD17643] | [RD18716] |
|---|---|---|---|---|
| Yellow coupler | 1001 | VII-D | VII C-G | |
| Magenta coupler | 1001 | VII-D | VII C-G | |
| Cyan coupler | 1001 | VII-D | VII C-G | |
| Colored coupler | 1002 | VII-G | VII G | |
| DIR coupler | 1001 | VII-F | VII-F | |
| BAR coupler | 1002 | VII-F | | |
| Other couplers which release useful residue | 1001 | VII-F | | |
| Alkali-soluble coupler | 1001 | VII-E | | |

The additives used for the present invention can be added by, for example, the dispersion method described in RD308119 XIV.

In the present invention, the supports described in the above RD17643, p. 28, RD18716 pp. 647-648 and RD308119 XVII.

The light-sensitive material of the present invention may be provided with auxiliary layers such as a filter layer and an interlayer as described in the above RD308119 VII-K.

The light-sensitive material of the present invention can have various layer structures such as ordinary layer structure, reverse layer structure and unit structure as described in the above RD308119 VII-K.

The present invention is applicable to various color light-sensitive materials represented by color negative films for ordinary or movie use, color reversal films for slides or televisions, color papers, color positive films, and color reversal papers.

The light-sensitive material of the present invention can be developed by the ordinary processes described in the above RD17643 pp. 28-29, RD18716 p. 647 and RD308119 XIX.

EXAMPLES

The present invention is hereinafter described in more detail by means of the following examples, but the modes of embodiment of the present invention are not limited to these examples.

Preparation of Fine Grains of AgI

An aqueous solution containing 5 wt % ossein gelatin was added to a reaction vessel, and 1 mol of a 3.5N aqueous solution of silver nitrate and 1 mol of a 3.5N aqueous solution of potassium iodide were added at constant rate over a period of 30 minutes with stirring at 40° C.

During the addition, a pAg of 13.5 was maintained by a conventional method of pAg control. The resulting silver iodide was found to be a mixture of $\beta$-AgI and $\gamma$-AgI of 0.06 $\mu$m in average grain size.

This emulsion is referred to as AgI fine grain emulsion.

Preparation of Spherical Twin Crystal Seed Emulsion

A monodispersed spherical seed emulsion was prepared as follows:

| | | |
|---|---|---|
| $A_3$ | | |
| Ossein gelatin | 150 | g |
| Potassium bromide | 53.1 | g |
| Potassium iodide | 24 | g |
| Water was added to make a total quantity of | 7.2 | l. |
| $B_3$ | | |
| Silver nitrate | 1.8 | kg |
| Water was added to make a total quantity of | 6 | l. |
| $C_3$ | | |
| Potassium bromide | 1327 | g |
| 1-phenyl-5-mercaptotetrazole (dissolved in methanol) | 0.3 | g |
| Water was added to make a total quantity of | 3 | l |
| $D_3$ | | |
| Aqueous ammonia (28%) | 705 | ml |

To solution $A_3$ being vigorously stirred at 40° C., solutions $B_3$ and $C_3$ were added by the double jet method over a period of 30 seconds to form cores. pBr was maintained between 1.09 and 1.15.

One minute and 30 seconds later, solution $D_3$ was added over a period of 20 seconds, followed by ripening for 5 minutes. During ripening, the KBr concentration was 0.071 mol/l and the ammonia concentration was 0.63 mol/l.

Then, the mixture was adjusted to pH 6.0, immediately followed by desalting and washing. Electron microscopy revealed that this seed emulsion was a monodispersed spherical emulsion of 0.36 μm in average grain size and 18% in distribution width.

This emulsion is hereinafter referred to as seed emulsion.

Preparation of Emulsion of the Present Invention

Using the six solutions described below, an emulsion of 7.9 mol % in average silver iodide content and 0.85 μm in grain size according to the present invention was prepared.

| | | |
|---|---|---|
| Solution $A_1$ | | |
| Ossein gelatin | 214 | g |
| Distilled water | 7070 | ml |
| Ammonium hydroxide (aqueous ammonia) | 13.6 | mol |
| Seed emulsion | 0.717 | mol |
| Distilled water was added to make a total quantity of | 11300 | ml. |

Solution $B_1$

A 3.5N aqueous solution of ammoniacal silver nitrate with its pH reduced to 9 with nitric acid after forming ammoniacal silver nitrate.

Solution $C_1$

A 3.5N aqueous solution of potassium bromide.

| | | |
|---|---|---|
| Solution $D_1$ | | |
| AgI fine grain emulsion | 1.0 | mol |
| 4-hydroxy-6-methyl-1,3,3a,6-tetraazaindene | 4.8 | g |
| Distilled water was added to make a total quantity of | 1260 | ml. |

-continued

Solution $E_1$

A 1.75N aqueous solution of potassium bromide.

Solution $F_1$

A 56 wt % aqueous solution of acetic acid.

Using the mixer agitator disclosed in Japanese Patent Examined Publication Nos. 58288/1983 and 58289/1983, solutions $B_1$, $C_1$ and $D_1$ were added to solution $A_1$ at 60° C. by the double-jet precipitation method over a period of 114 minutes, and the seed crystal was grown until it reached 0.85 μm in diameter.

Solutions $B_1$ and $C_1$ were added at an appropriate rate changed as a function of time according to the critical rate of grain growth to prevent the occurrence of small grains other than growing seed crystals and polydispersion due to Ostwald ripening. Supply of solution $D_1$, i.e., the silver iodide fine grain emulsion, was performed while changing the ratio of its addition rate (molar ratio) to the addition rate of the aqueous solution of ammoniacal silver nitrate with respect to grain size (addition time) to prepare a multiple-layered core/shell emulsion (Table 1).

Also, by using solutions $E_1$ and $F_1$, the pAg and pH during crystal growth were controlled as shown in Table 1. Determination of pAg and pH was made in accordance with standard methods using a silver sulfide electrode and a glass electrode.

Next, the core/shell emulsion was desalted by a conventional method and then gelatin was added and dissolved therein. The entire amount of emulsion (10 mol) was diluted with distilled water to make a total quantity of 4250 ml. A pH of 5.80 and a pAg of 8.1 were maintained at 40° C.

Electron microscopy revealed that this emulsion comprised monodispersed twin crystal grains of 0.85 μm in average grain size.

TABLE 1

| | Addition time | Grain size | Flow rate ratio* | pH | pAg |
|---|---|---|---|---|---|
| Core | 0.0 min | 0.33 | 0 | 7.0 | 7.80 |
| | 29.0 | 0.43 | 0 | 7.0 | 7.80 |
| | 29.1 | 0.43 | 100 | 7.0 | 7.80 |
| | 35.0 | 0.45 | 100 | 7.0 | 7.80 |
| | 35.0 | 0.45 | 35 | 7.0 | 7.80 |
| | 59.2 | 0.52 | 35 | 7.0 | 7.80 |
| | 59.2 | 0.52 | 10 | 7.0 | 7.80 |
| | 67.3 | 0.55 | 10 | 7.0 | 7.80 |
| | 69.1 | 0.55 | 10 | 7.0 | 7.80 |
| | 72.7 | 0.56 | 10 | 7.0 | 7.80 |
| Shell | 72.7 | 0.56 | 10 | 6.0 | 9.70 |
| | 78.1 | 0.57 | 10 | 6.0 | 9.75 |
| | 78.1 | 0.57 | 3 | 6.0 | 9.75 |
| | 100.1 | 0.67 | 3 | 6.0 | 10.10 |
| | 112.4 | 0.79 | 3 | 6.0 | 10.10 |
| | 112.4 | 0.79 | 0 | 6.0 | 10.10 |
| | 114.3 | 0.81 | 0 | 6.0 | 10.10 |

*Solution $D_1$ flow rate ratio =

$$\frac{\text{Solution } D_1 \text{ molar flow rate (mol/min)}}{\text{Solution } D_1 \text{ molar flow rate (mol/min)} + \text{Solution } B_1 \text{ molar flow rate (mol/min)}} \times 100$$

This emulsion is hereinafter referred to as Em-1.

Using the three aqueous solutions, emulsion solution containing AgI fine grain emulsion and seed emulsion described below, an emulsion of 1.40 μm in average grain size of the present invention was prepared.

| | |
|---|---|
| Aqueous solution $A_2$ | |
| Gelatin | 231.9 g |
| 10% methanol solution of the following compound [I] | 30.0 ml |
| 28% aqueous ammonia | 1056 ml |
| Water was added to make a total quantity of | 11827 ml. |

Compound [I]

$$HO(CH_2CH_2O)m(\overset{\overset{CH_3}{|}}{C}HCH_2O)_{17}(CH_2CH_2O)nH$$

(average molecular weight is nearly 1300)

| | |
|---|---|
| Aqueous solution $B_2$ | |
| Silver nitrate | 1587 g |
| 28% aqueous ammonia | 1295 ml |
| Water was added to make a total quantity of | 2669 ml. |
| Aqueous solution $C_2$ | |
| Potassium bromide | 1572 g |
| Water was added to make a total quantity of | 3774 ml. |
| Solution $D_2$ containing silver iodide fine grains | |
| AgI fine grain emulsion | 1499.3 g |
| 4-hydroxy-6-methyl-1,3,3a,7-tetraazaindene | 5.2 g |
| 10% aqueous solution of potassium hydroxide | 14.75 ml |
| Water was added to make a total quantity of | 1373 ml. |

A 0.407 mol equivalent seed emulsion was added to aqueous solution $A_2$ of the composition described above while vigorously stirring the solution at a temperature of 60° C., and the pH and pAg were adjusted with acetic acid and an aqueous solution of potassium bromide.

Thereafter, while controlling the pH and pAg as shown in Table 2, solutions $B_2$ and $C_2$ and an emulsion solution $D_2$ containing fine grains of silver iodide were added at the flow rates shown in Table 3, respectively, by the triple jet method.

After completion of addition, an aqueous solution of phenylcarbamyl gelatin was added, and the mixed solution was adjusted to an appropriate pH to coagulate the emulsion, followed by desalting and washing.

Thereafter, the solution was adjusted to a pH of 5.80 and a pAG of 8.06 at 40° C.

Thus, a monodispersed silver iodobromide emulsion having an average grain size of 1.25 μm, an average silver iodide content of 8.0 mol % and a grain size distribution width of 13.2% was obtained.

This emulsion is referred to as Em-2.

The grain structure and volume ratio by internal phase of the Em-2 grain are given in Table 4.

TABLE 2

| | Em-2 grain growth conditions | | | | | | | | |
|---|---|---|---|---|---|---|---|---|---|
| Ag (%) | 0 | | 29 | | 29 | | 56 | | 100 |
| pH | 7.0 | → | 7.0 | ↓ | 6.0 | → | 6.0 | → | 6.0 |

TABLE 2-continued

| | Em-2 grain growth conditions | | | | | | | | |
|---|---|---|---|---|---|---|---|---|---|
| Ag (%) | 0 | | 29 | | 29 | | 56 | | 100 |
| pAg | 7.8 | → | 7.8 | ↓ | 9.7 | ↘ | 10.1 | → | 10.1 |

→ indicates that pH and pAg are maintained at constant level;

↘ indicates continuous reduction;

↓ indicates rapid reduction.

TABLE 3

| Addition patterns | | | | | |
|---|---|---|---|---|---|
| Solution $B_2$ | | Solution $C_2$ | | Solution $D_2$ | |
| Time (min) | Addition rate (ml/min) | Time (min) | Addition rate (ml/min) | Time (min) | Addition (ml/min) |
| 0 | 12.2 | 0 | 10.9 | 0 | 0 |
| 25.6 | 13.0 | 25.6 | 11.7 | 43.9 | 0 |
| 42.6 | 12.9 | 42.6 | 11.6 | 43.9 | 73.6 |
| 43.9 | 8.4 | 43.9 | 7.6 | 51.7 | 80.6 |
| 67.5 | 11.0 | 97.3 | 13.3 | 52.5 | 28.5 |
| 97.3 | 14.8 | 97.7 | 18.6 | 84.3 | 40.4 |
| 97.7 | 20.6 | 105.0 | 20.0 | 84.9 | 11.6 |
| 105.0 | 22.3 | 105.0 | 36.5 | 97.7 | 13.0 |
| 105.4 | 25.4 | 112.0 | 56.2 | 105.0 | 14.1 |
| 112.3 | 32.1 | 112.3 | 60.6 | 105.4 | 16.3 |
| 112.6 | 35.1 | 121.2 | 106.0 | 112.3 | 20.6 |
| 129.4 | 90.3 | 121.4 | 91.4 | 112.6 | 6.2 |
| 145.7 | 194.2 | 132.4 | 263.3 | 130.4 | 17.5 |
| 145.7 | 200.5 | 132.7 | 141.8 | 132.7 | 22.1 |
| 147.4 | 203.9 | 147.4 | 230.0 | 145.7 | 34.4 |

TABLE 4

| | Phase 1 (seed) | Phase 2 | Phase 3 | Phase 4 | Phase 5 | Phase 6 |
|---|---|---|---|---|---|---|
| Formulated silver iodide content (mol %) | 2 | 0 | 35 | 10 | 3 | 0 |
| $D_2/B_2$ molar addition rate ratio (%) | 0 | 0 | 100 35 10 | 10 | 3 | 0 |
| Volume ratio (%) | 3.8 | 9.2 | 15.8 1.8 9.2 4.8 | 6.7 | 58.7 | 5.8 |

Preparation of Comparative Emulsions

Comparative Example 1

In accordance with the method described in Example 3 of Japanese Patent Examined Publication No. 38692/1989, a silver iodobromide emulsion of 8.0 mol % in average silver iodide content containing tabular silver halide grains having a phase of high silver iodide content in the core was prepared.

| | |
|---|---|
| $A_3$ | |
| Gelatin | 30 g |
| Potassium bromide | 10.3 g |
| 0.5 wt % thioether I aqueous solution $[HO(CH_2)_2S(CH_2)_2S(CH_2)_2OH]$ | 20 ml |
| Water was added to make a total quantity of | 1 l. |
| $B_{3\text{-}1}$ | |
| Silver nitrate | 4.5 g |
| Water | 17 ml |
| $C_{3\text{-}1}$ | |
| Potassium bromide | 3.15 g |
| 0.5 wt % thioether I aqueous solution | 0.45 ml |
| Water | 16.7 ml |
| $B_{3\text{-}2}$ | |

-continued

| | | |
|---|---|---|
| [ | Silver nitrate | 95.5 g |
| | Water | 561 ml |
| $C_{3-2}$ | | |
| [ | Potassium bromide | 69.6 g |
| | 0.5 wt % thioether I aqueous solution | 9.6 ml |
| | Water | 542 ml |
| $D_3$ | | |
| | 10% potassium iodide | 78.1 ml |

Solution $A_3$ being kept at a pAg of 9.0 and a pH of 6.5 at 77° C. was vigorously stirred, and solutions $B_{3-1}$ and $C_{3-1}$ were simultaneously added over a period of 10 seconds. Subsequently, solutions $B_{3-2}$ and $C_{3-2}$ were simultaneously added by the double jet method over a period of 65 minutes. Addition was once stopped 20 minutes after initiation of addition of solutions $B_{3-2}$ and $C_{3-1}$, and solution $D_3$ was added over a period of 5 minutes, and then solutions $B_{3-2}$ and $C_{3-2}$ were again added.

After completion of addition, desalting and washing were performed by standard methods. This emulsion is referred to as Em-A-1.

Comparative Example 2

A comparative emulsion Em-A-2 was prepared in the same manner as in Comparative Example 1 except that solution $A_3$ was kept at 65° C. This emulsion is referred to as Em-A-2.

Comparative Example 3

In accordance with the method of Japanese Patent Publication Open to Public Inspection No. 209445/1987, a silver iodobromide emulsion of 8.0 mol % in average silver iodide content containing tabular silver halide grains having a phase of high silver iodide content in the core was prepared.

| | | |
|---|---|---|
| $A_4$ | | |
| [ | Inert gelatin | 30 g |
| | Potassium bromide | 6 g |
| | Water | 1 l |
| $B_{4-1}$ | | |
| [ | Silver nitrate | 5.0 g |
| | Water was added to make a total quantity of | 35 ml. |
| $C_{4-1}$ | | |
| [ | Potassium bromide | 3.2 g |
| | Potassium iodide | 0.98 g |
| | Water | 35 ml |

To solution $A_4$ being stirred at 60° C., solutions $B_{4-1}$ and $C_{4-1}$ were added over a period of 30 seconds. Then, the pAg was raised to 10, and ripening was carried out for 30 minutes to yield a seed emulsion.

| | | |
|---|---|---|
| $B_{4-2}$ | | |
| [ | Silver nitrate | 145 g |
| | Water was added to make a total quantity of | 1 l. |
| $C_{4-2}$ | | |
| [ | Potassium bromide | 43.1 g |
| | Potassium iodide | 10.7 g |
| | Water was added to make a total quantity of | 500 ml. |
| $C_{4-3}$ | | |
| [ | Potassium bromide | 50.8 g |
| | Water was added to make a total quantity of | 500 ml. |

Subsequently, solutions $B_{4-2}$ and $C_{4-2}$ in a equimolar ratio were added at a rate near the critical growth rate at a given temperature and given pAg to yield a core emulsion, followed by addition of the remaining portion of solution $B_{4-2}$ and solution $C_{4-3}$ in an equimolar ratio at a rate near the critical growth rate to cover the core grain to yield a core/shell grain emulsion. After completion of addition, desalting and washing were carried out by standard methods.

This emulsion is referred to as Em-B-1.

Comparative Example 4

A comparative emulsion Em-B-2 was prepared in the same manner as with Em-B-1 of Comparative Example 3 except that solution $A_4$ was kept at 45° C. This emulsion is referred to as Em-B-2.

Comparative Example 5

In accordance with the method of Japanese Patent Publication Open to Public Inspection No. 183644/1989, a silver iodobromide emulsion of 9.6 mol % in average silver iodide content containing tabular silver halide grains having a phase of high silver iodide content in the outer portion was prepared.

Preparation of Tabular Silver Bromide Nucleus Grains

To 1.3 l of a 0.8 wt % gelatin solution containing 0.08M potassium bromide while stirring, 150 ml of a 2.0M silver nitrate solution and a 2.0M potassium bromide solution were added by the double jet method, while keeping the gelatin solution at 30° C. After this addition, temperature was increased to 70° C., and 30 g of gelatin was added, followed by ripening for 30 minutes.

The tabular silver bromide grains (hereinafter referred to as seed crystal) thus formed was washed by the standard flocculation method and adjusted to a pH of 6.0 and a pAg of 7.5 at 40° C. The obtained tabular grains had an average projected area circle equivalent diameter of 0.4 μm.

A 1/10 portion of this seed crystal was dissolved in 1 l of a solution containing 3 wt % gelatin, and this solution was kept at a temperature of 75° C. and a pBr of 1.1.

To a high-power efficient mixer placed at the reaction vessel, an aqueous solution containing 150 g of silver nitrate, a solution of potassium bromide and silver nitrate in a equimolar ratio containing 10 mol % of potassium iodide, and 250 ml of an aqueous solution of 3 wt % gelatin were added at increasing flow rate (the flow rate at completion of addition was 10 times that at initiation) by the triple jet method over a period of 80 minutes. The very fine grains which were formed by stirring and reaction in the mixer were immediately introduced into the reaction vessel continuously. Throughout this procedure, the mixer was kept at a temperature of 35° C. and a pBr of 2.6. Then, desalting and washing were performed by conventional methods.

This emulsion is referred to as Em-C-1.

Comparative Example 6

A comparative emulsion Em-C-2 was prepared in the same manner as with Em-C-1 of Comparative Example 5 except that the amount of tabular silver bromide core grains used for seed grain growth was changed to 2.13 times that used in Comparative Example 5.

TABLE 5

| Emulsion | Average grain size (μm) | Distribution width (%) | Average silver iodide content $J_1$ (mol/%) | Grain outer portion silver iodide content $J_2$ (mol %) | Silver iodide content relative standard deviation (%) |
|---|---|---|---|---|---|
| Em-1 | 0.85 | 13.2 | 7.9 | 0.0 | 8.2 |
| Em-2 | 1.25 | 14.0 | 8.0 | 0.0 | 9.0 |
| Em-A-1 | 1.74 | 25.2 | 8.0 | 0.1 | 22.7 |
| Em-A-2 | 1.37 | 22.0 | 8.0 | 0.1 | 21.2 |
| Em-B-1 | 1.66 | 32.1 | 8.0 | 0.1 | 16.1 |
| Em-B-2 | 1.33 | 31.4 | 8.0 | 0.1 | 18.3 |
| Em-C-1 | 1.88 | 15 3 | 9.6 | 10.0 | 9.5 |
| Em-C-2 | 1.49 | 15.2 | 9.6 | 10.0 | 9.1 |

| Emulsion | X-ray diffraction: Signal width Peak × 0.13 (degree) | X-ray diffraction: Signal width Peak × 0.15 (degree) | X-ray diffraction: Number of peak | Surface iodide content $J_3$ (mol %) | Average grains: Ratio 1 (*1) (%) | Average grains: Average diameter/thickness ratio | Average grains: Ratio 2 (*2) (%) |
|---|---|---|---|---|---|---|---|
| Em-1 | 2.15 | 2.05 | 3 | 0.0 | 82 | 1.8 | 82 |
| Em-2 | 2.17 | 2.06 | 3 | 0.0 | 85 | 3.3 | 85 |
| Em-A-1 | 1.60 | 1.47 | 1 | 0.1 | 67 | 8.1 | 16 |
| Em-A-2 | 1.57 | 1.45 | 1 | 0.1 | 72 | 7.4 | 18 |
| Em-B-1 | 1.46 | 1.40 | 2 | 0.2 | 65 | 7.0 | 17 |
| Em-B-2 | 1.45 | 1.38 | 2 | 0.2 | 68 | 6.8 | 20 |
| Em-C-1 | 1.00 | 0.98 | 1 | 10.0 | 80 | 10.2 | 7 |
| EM-C-2 | 1.02 | 0.99 | 1 | 9.8 | 81 | 9.5 | 10 |

(*1) Proportion of all tabular grains in projection area
(*2) Proportion of tabular grains having a ratio of diameter to thickness of less than 5

Preparation of Silver Halide Color Light-Sensitive Materials

In Examples given below, figures for addition amount in silver halide photographic light-sensitive material are expressed in gram per $m^2$ unless otherwise stated. For silver halide and colloidal silver, figures are given as silver content. For sensitizing dyes, figures are mol per mol silver.

Layers of the following compositions were formed on a triacetyl cellulose film support in this order from the support side to yield a multiple-layered color photographic light-sensitive material sample No. 101.

| Sample No. 101 | |
|---|---|
| Layer 1: Anti-halation layer HC-1 | |
| Black colloidal silver | 0.2 |
| UV absorbent UV-1 | 0.23 |
| High boiling solvent Oil-1 | 0.18 |
| Gelatin | 1.4 |
| Layer 2: First interlayer IL-1 | |
| Gelatin | 1.3 |
| Layer 3: Low speed red-sensitive emulsion layer RL | |
| Silver iodobromide emulsion (average grain size 0.4 μm) | 1.0 |
| Sensitizing dye SD-1 | $1.8 \times 10^{-5}$ |
| Sensitizing dye SD-2 | $2.8 \times 10^{-4}$ |
| Sensitizing dye SD-3 | $3.0 \times 10^{-4}$ |
| Cyan coupler C-1 | 0.70 |
| Colored cyan coupler CC-1 | 0.066 |
| DIR compound D-1 | 0.03 |
| DIR compound D-3 | 0.01 |
| High boiling solvent Oil-1 | 0.64 |
| Gelatin | 1.2 |
| Layer 4: Moderate speed red-sensitive emulsion layer RM | |
| Silver iodobromide emulsion Em-1 | 0.8 |
| Sensitizing dye SD-1 | $2.1 \times 10^{-5}$ |
| Sensitizing dye SD-2 | $1.9 \times 10^{-4}$ |
| Sensitizing dye SD-3 | $1.9 \times 10^{-4}$ |
| Cyan coupler C-1 | 0.28 |
| Colored cyan coupler CC-1 | 0.027 |
| DIR compound D-1 | 0.01 |
| High boiling solvent Oil-1 | 0.26 |

-continued

| Sample No. 101 | |
|---|---|
| Gelatin | 0.6 |
| Layer 5: High speed red-sensitive emulsion layer RH | |
| Silver iodobromide emulsion Em-2 | 1.70 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler C-1 | 0.05 |
| Cyan coupler C-2 | 0.10 |
| Colored cyan coupler CC-1 | 0.02 |
| DIR compound D-1 | 0.025 |
| High boiling solvent Oil-1 | 0.17 |
| Gelatin | 1.2 |
| Layer 6: Second interlayer IL-2 | |
| Gelatin | 0.8 |
| Layer 7: Low speed green-sensitive emulsion layer GL | |
| Silver iodobromide emulsion (average grain size 0.4 μm) | 1.1 |
| Sensitizing dye SD-4 | $6.8 \times 10^{-5}$ |
| Sensitizing dye SD-5 | $6.2 \times 10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: Moderate speed green-sensitive emulsion layer GM | |
| Silver iodobromide emulsion Em-1 | 0.7 |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |
| Magenta coupler M-1 | 0.07 |
| Magenta coupler M-2 | 0.03 |
| Colored magenta coupler CM-1 | 0.04 |
| DIR compound D-2 | 0.018 |
| High boiling solvent Oil-2 | 0.30 |
| Gelatin | 0.8 |
| Layer 9: High speed green-sensitive emulsion layer GH | |
| Silver iodobromide emulsion Em-2 | 1.7 |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-5}$ |
| Magenta coupler M-1 | 0.09 |
| Magenta coupler M-3 | 0.04 |
| Colored magenta coupler CM-1 | 0.04 |
| High boiling solvent Oil-2 | 0.31 |

-continued

| Sample No. 101 | |
|---|---|
| Gelatin | 1.2 |
| Layer 10: Yellow filter layer YC | |
| Yellow colloidal silver | 0.05 |
| Anti-color staining agent SC-1 | 0.1 |
| High boiling solvent Oil-2 | 0.13 |
| Gelatin | 0.7 |
| Formalin scavenger HS-1 | 0.09 |
| Formalin scavenger HS-2 | 0.07 |
| Layer 11: Low speed blue-sensitive emulsion layer BL | |
| Silver iodobromide emulsion (average grain size 0.4 μm) | 0.5 |
| Silver iodobromide emulsion (average grain size 0.7 μm) | 0.5 |
| Sensitizing dye SD-9 | $5.2 \times 10^{-4}$ |
| Sensitizing dye SD-10 | $1.9 \times 10^{-5}$ |
| Yellow coupler Y-1 | 0.65 |
| Yellow coupler Y-2 | 0.24 |
| DIR compound D-1 | 0.03 |
| High boiling solvent Oil-2 | 0.18 |
| Gelatin | 1.3 |
| Formalin scavenger HS-1 | 0.08 |
| Layer 12: High speed blue-sensitive emulsion layer BH | |
| Silver iodobromide emulsion (average grain size 1.0 μm) | 1.0 |
| Sensitizing dye SD-9 | $1.8 \times 10^{-4}$ |
| Sensitizing dye SD-10 | $7.9 \times 10^{-5}$ |
| Yellow coupler Y-1 | 0.15 |
| Yellow coupler Y-2 | 0.05 |
| High boiling solvent Oil-2 | 0.074 |
| Gelatin | 1.3 |
| Formalin scavenger HS-1 | 0.05 |
| Formalin scavenger HS-2 | 0.12 |
| Layer 13: First protective layer Pro-1 | |
| Fine grain silver iodobromide emulsion (average grain size 0.08 μm, AgI content 1 mol %) | 0.4 |
| UV absorbent UV-1 | 0.07 |
| UV absorbent UV-2 | 0.10 |

-continued

| Sample No. 101 | |
|---|---|
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer Pro-2 | |
| Alkali-soluble matting agent (average grain size 2 μm) | 0.13 |
| Polymethyl methacrylate (average grain size 3 μm) | 0.02 |
| Lubricant WAX-1 | 0.04 |
| Gelatin | 0.6 |

In addition to these compositions, a coating aid Su-2, a dispersing agent Su-2, a viscosity increasing agent, hardeners H-1 and H-2, a stabilizer ST-1, an antifogging agent AF-1 and two kinds of AF-2 having an average molecular weight of 10,000 or 1,100,000, respectively, were added.

The emulsions used to prepare the sample described above are listed in Table 6.

Sample Nos. 102 through 104 were prepared in the same manner as with sample No. 101 except that the silver halide emulsions for layers 4, 5, 8 and 9 were changed as shown in Table 6. Each emulsion was subjected to optimum sensitization with gold and sulfur.

TABLE 6

| Sample number | Silver halide emulsion for layers 4 and 8 | Silver halide emulsion for layers 5 and 9 |
|---|---|---|
| 101 | Em-1 | Em-2 |
| 102 | Em-A-2 | Em-A-1 |
| 103 | Em-B-2 | Em-B-1 |
| 104 | Em-C-2 | Em-C-1 |

C-1

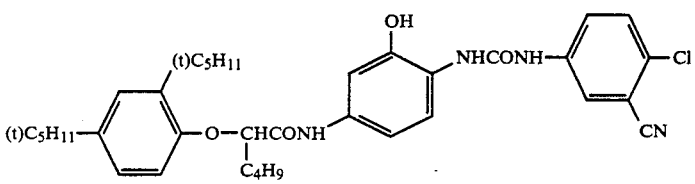

C-2

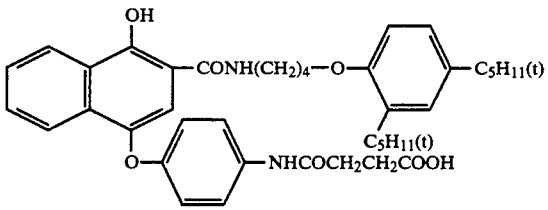

M-1

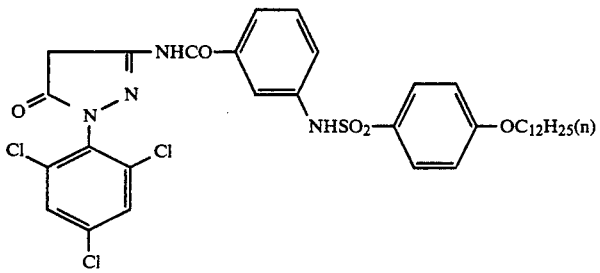

-continued
M-2
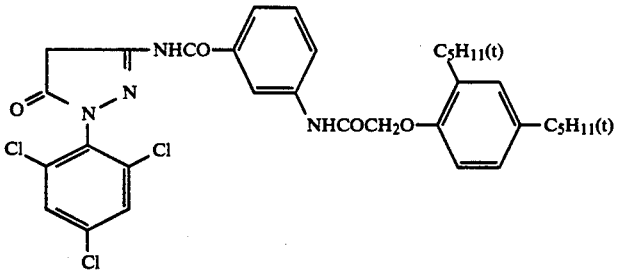
M-3
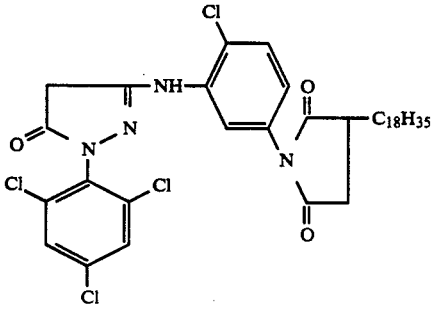
Y-1
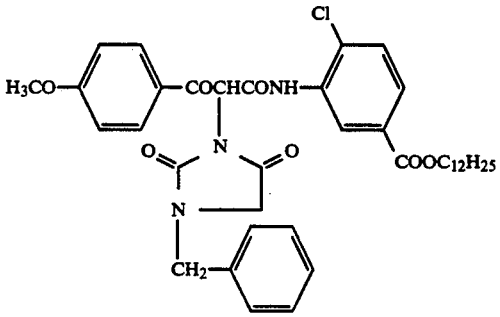
Y-2
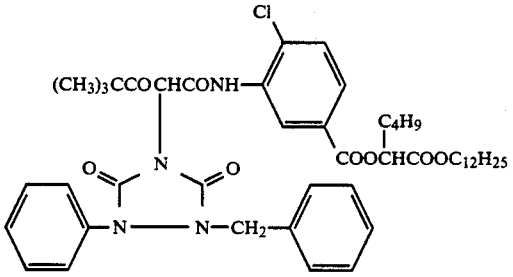
CC-1
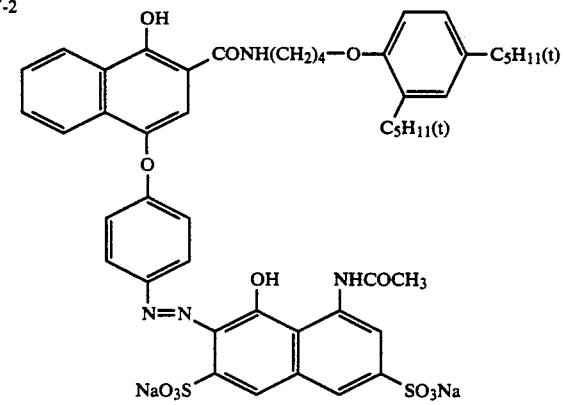
CM-1
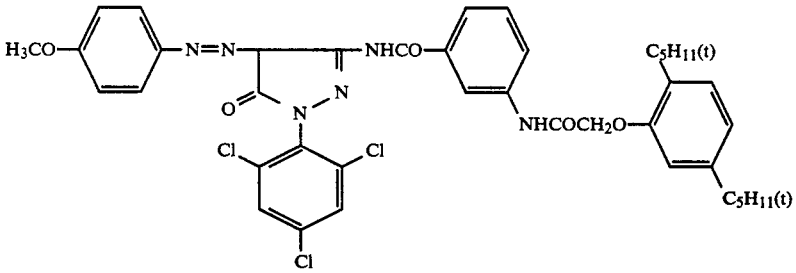
D-1
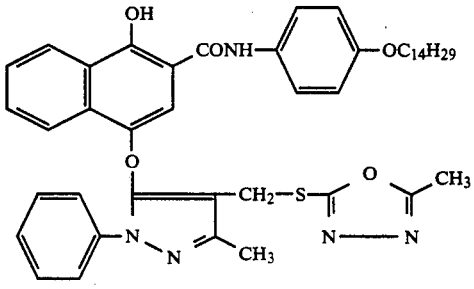
D-2
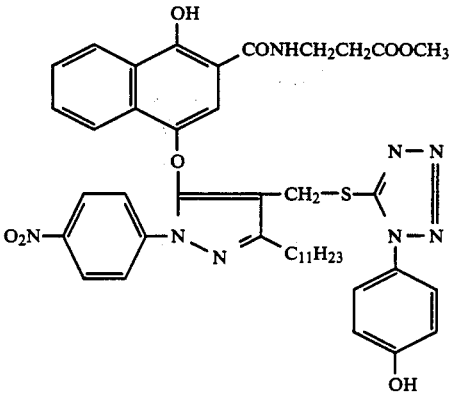

-continued
D-3
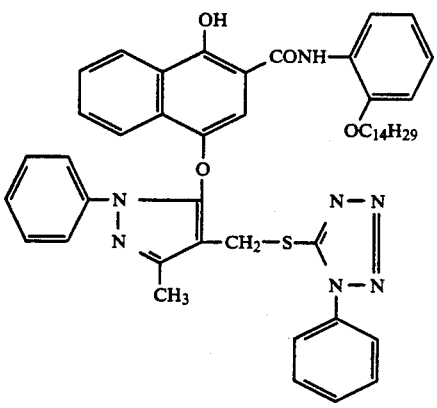
Oil-1
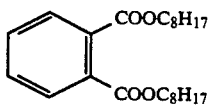
Oil-2
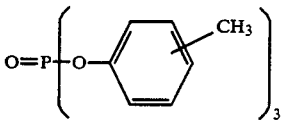
Oil-3
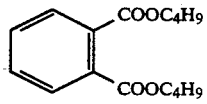
SC-1
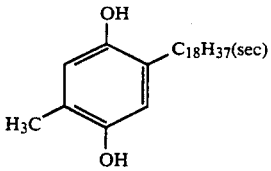
UV-1
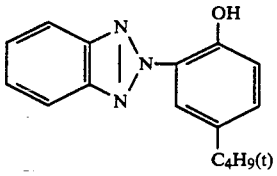
UV-2
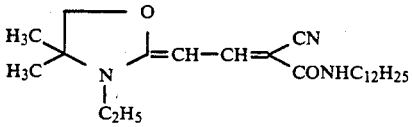
WAX-1
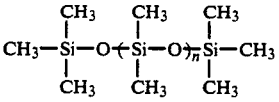
Weight average molecular weight Mw = 3,000
Su-1
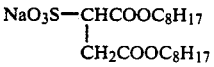
Su-2
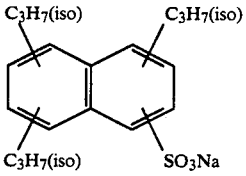
HS-1
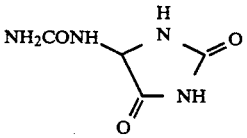
HS-2
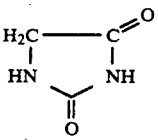
SD-1
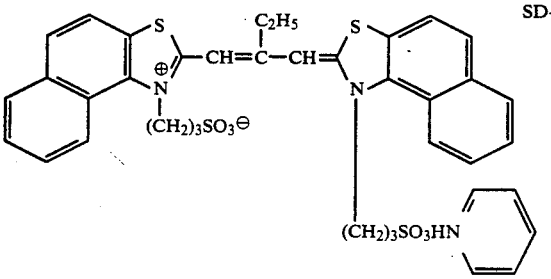
SD-2
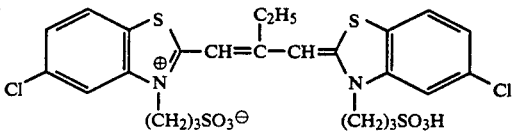

-continued
SD-3
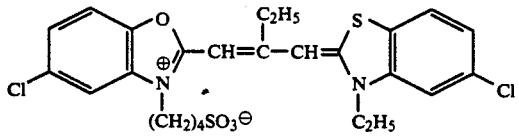
SD-4
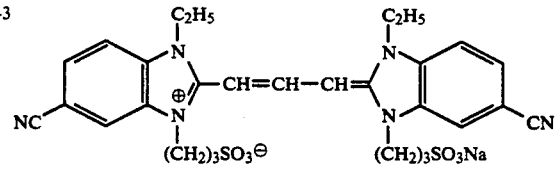
SD-5
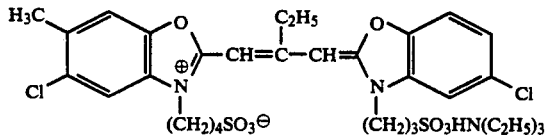
SD-6
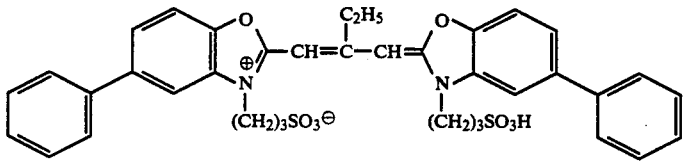
SD-7
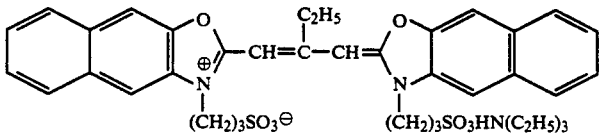
SD-8
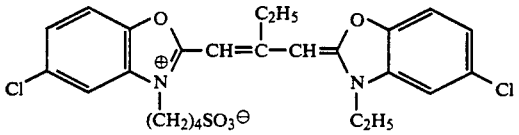
SD-9
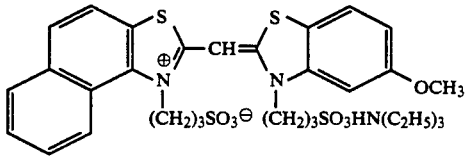
SD-10
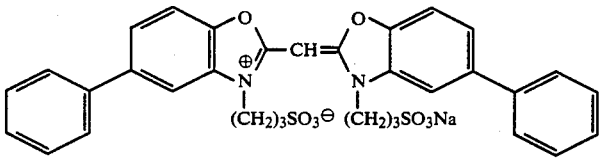
H-1
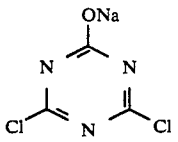
H-2 $(CH_2{=}CHSO_2CH_2)_2O$
ST-1
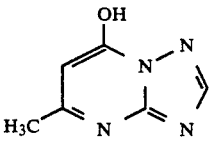
AF-1
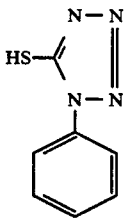
AF-2
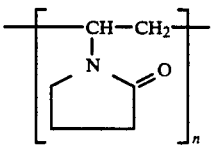
n: Degree of polymerization
Sample Nos. 101 through 104 thus prepared were exposed to white light through an optical wedge for 1/100 second, followed by the developing process described below.

| Processing procedure [I] (38° C.) | |
|---|---|
| Color development | 3 minutes 10 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processing steps had the following compositions:

| | |
|---|---|
| [Color developer] | |
| 4-amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water was added to make a total quantity of 1 l (pH = 10.0) | |
| [Bleacher] | |
| Iron (III) ammonium ethylenediaminetetra-acetate | 100 g |
| Diammonium ethylenediaminetetraacetate | 10.0 g |
| Ammonium bromide | 150.0 g |
| Glacial acetic acid | 10 ml |
| Water was added to make a total quantity of 1 l, and aqueous ammonia was added to obtain a pH of 6.0. | |
| [Fixer] | |
| Ammonium thiosulfate | 175.0 g |
| Anhydrous sodium sulfite | 8.5 g |
| Sodium metasulfite | 2.3 g |
| Water was added to make a total quantity of 1 l, and acetic acid was added to obtain a pH of 6.0. | |
| [Stabilizer] | |
| Formalin (37% aqueous solution) | 1.5 ml |
| Konidax (produced by Konica Corporation) | 7.5 ml |
| Water was added to make a total quantity of 1 l. | |

Results of sensitometric evaluation and measurements of RMS granularity at a density of fog +0.5 for sample Nos. 101 through 104 after development are given in Table 7.

RMS granularity was determined by scanning the subject portion of each sample using a microdensitometer with an aperture of 1800 $\mu m^2$ (slit width 10 μm, slit length 180 μm), and obtained results are expressed in 1000-fold value of the standard deviation for variance in density among more than 1000 times of density sampling.

The RMS granularity of each of the green- and red-sensitive layers was determined using Wratten filter W-99 and W-26, respectively, produced by Eastman Kodak.

TABLE 7

| Sample number | Red density | | | Green density | | |
|---|---|---|---|---|---|---|
| | Fog | Sensi-tivity | Granu-larity | Fog | Sensi-tivity | Granu-larity |
| 101 (inventive) | 0.04 | 165 | 92 | 0.05 | 155 | 93 |
| 102 (comparative) | 0.06 | 100 | 100 | 0.07 | 100 | 100 |
| 103 (comparative) | 0.06 | 116 | 98 | 0.07 | 114 | 97 |
| 104 (comparative) | 0.06 | 120 | 97 | 0.07 | 118 | 96 |

TABLE 7-continued

*FIGS. for sensitivity are given in percent ratio to the red density or green density obtained in sample No. 102.

*FIGS. for granularity are given in percent ratio to the RMS granularity for red density or green density obtained in sample No. 102.

As seen in Table 7, with respect to the silver halide photographic light-sensitive material (sample No. 101) prepared with an emulsion of the present invention, noticeable sensitization was noted in comparison with the comparative samples. Moreover, sample No. 101 was found to tend to show reduced fog and improved granularity.

Also, sample Nos. 101 through 104 were exposed to white light through an optical wedge for 1/100 second, followed by the developing process, sensitometry and granularity evaluation described below; similar effects were confirmed.

Process was run until the replenisher was supplied in an amount three times the capacity of the stabilization tank.

| Processing step | Processing | Processing temperature | Amount of replenisher |
|---|---|---|---|
| Color development | 3 min 15 sec | 38° | 540 ml |
| Bleaching | 45 sec | 38° | 155 ml |
| Fixation | 1 min 45 sec | 38° | 500 ml |
| Stabilization | 90 sec | 38° | 775 ml |
| Drying | 1 min | 40 to 70° | — |

Note:
FIGS. for the amount of replenisher are values per $m^2$ light-sensitive material.

Stabilization was conducted by the 3-vessel-counter-current method, wherein the replenisher was fed to the final stabilizer tank and the overflow solution flew into the tank before the final tank.

Also, a part (275 ml/$m^2$) of the overflow solution from the stabilization tank after the fixation tank was returned into the stabilization tank.

The composition of the color developer used is as follows:

| | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-amino-3-methyl-N-ethyl-N-(β-hydroxyethyl) aniline sulfate | 4.6 g |
| Diethylenetriamine pentaacetate | 3.0 g |
| Potassium hydroxide | 1.3 g |

Water was added to make a total quantity of 1 l, and potassium hydroxide or 20% sulfuric acid was used to obtain a pH of 10.01.

The composition of the color developer replenisher used is as follows:

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxyethyl) | 6.0 g |

-continued

| | |
|---|---|
| aniline sulfate | |
| Diethylenetriamine pentaacetate | 3.0 g |
| Potassium hydroxide | 2 g |

Water was added to make a total quantity of 1 l, and potassium hydroxide or 20% sulfuric acid was used to obtain a pH of 10.12.

The composition of the bleacher used is as follows:

| | |
|---|---|
| Ferric ammonium 1,3-diaminopropanetetra-acetate | 0.35 mol |
| Disodium ethylenediaminetetraacetate | 2 g |
| Ammonium bromide | 150 g |
| Glacial acetic acid | 40 ml |
| Ammonium nitrate | 40 g |

Water was added to make a total quantity of 1 l, and aqueous ammonia or glacial acetic acid was used to obtain a pH of 4.5.

The composition of the bleacher replenisher used is as follows:

| | |
|---|---|
| Ferric ammonium 1,3-diaminopropanetetra-acetate | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to make a total quantity of 1 l, and aqueous ammonia or glacial acetic acid was used to obtain a pH of 3.5, with proper adjustment made to maintain a given pH level of the bleacher tank solution.

The composition of the fixer and fixer replenisher used is as follows:

| | |
|---|---|
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |

Water was added to make a total quantity of 700 ml, and glacial acetic acid and aqueous ammonia were used to obtain a pH of 6.5.

The composition of the stabilizer and stabilizer replenisher used is as follows:

| | |
|---|---|
| 1,2-benzoisothiazolin-3-one | 0.1 g |
| 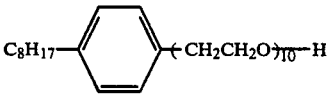 (50% solution) | 2.0 ml |
| Hexamethylenetetramine | 0.2 g |
| Hexahydro-1,3,5-tris-(2-hydroxyethyl)-5-triazine | 0.3 g |

-continued

Water was added to make a total quantity of 1 l, and potassium hydroxide and 50% sulfuric acid were used to obtain a pH of 7.0.

What is claimed is:

1. A silver halide photographic light-sensitive material comprising a silver halide photographic emulsion containing tabular silver halide twin crystal grains having a ratio of grain diameter to thickness of less than 5, wherein projection areas of said silver halide grains are 50 percent or more of total projection area of all grains; and said silver halide photographic emulsion satisfies all the following requirements (1) to (4):

(1) said silver halide grains are monodispersed and a (grain size standard deviation/average grain size)×100 is not more than 18;

(2) an average silver iodide content ($J_1$) determined by X-ray fluorometry is greater than an average value ($J_2$) for measurements of silver iodide content taken on a diameter of a silver halide crystal at a point distanced from its center, by 80 percent of said diameter as determined by X-ray microanalysis;

(3) for the silver iodide content of each silver halide grain determined by X-ray microanalysis, a relative standard deviation is not more than 20 percent; and (4) a signal exists over a range of 1.5 degrees or more of a diffraction angle at a height of a maximum peak height ×0.13 when a diffraction pattern of a (420) face of said silver halide grains is measured with an X-ray diffractometer using CuKα ray, said tabular silver halide grains being prepared by mixing (a) a water soluble silver salt solution, (b) a water soluble halide solution, and (c) a solution containing nondispersed twin crystal silver halide seed grains, said mixing being conducted in the presence of silver halide grains having a solubility product smaller than that of silver halide grains growing from said seed grains to said tabular silver halide grains at the time of said mixing.

2. A silver halide photographic material of claim 1, wherein said ratio of grain diameter to thickness is within the range of 1.1 to 5.

3. A silver halide photographic material of claim 1, wherein said silver halide photographic emulsion comprises silver iodobromide having a silver iodide content of 4 to 20 mol %.

4. A silver halide photographic material of claim 1, wherein in (4), said (420) diffraction pattern has 2 or 3 peaks.

5. A silver halide photographic material of claim 1, wherein said silver halide photographic emulsion satisfies a requirement wherein the average silver iodide content ($J_1$) obtained by X-ray fluorometry and the grain surface silver iodide content ($J_3$) obtained by X-ray photoelectron spectrometry bear the relationship of $J_1 > J_3$.

* * * * *